United States Patent [19]

Tzvetkov

[11] Patent Number: 4,525,787

[45] Date of Patent: Jun. 25, 1985

[54] PROGRAM AUTOMATON FOR WEAVING MACHINES

[75] Inventor: Krum K. Tzvetkov, Sofia, Bulgaria

[73] Assignee: Centralen Savet na Nauchnotechnicheski Sayusi, Sofia, Bulgaria

[21] Appl. No.: 419,325

[22] Filed: Sep. 17, 1982

[51] Int. Cl.[3] ..... D03D 51/08

[52] U.S. Cl. ..... 364/470; 139/1 K; 139/1 D; 139/324

[58] Field of Search ..... 139/1 R, 1 D, 324; 364/470

[56] References Cited

U.S. PATENT DOCUMENTS 3,674,991 4/1972 Tzvetkov et al. ..... 364/470

4,398,568 8/1983 Rydborn ..... 139/1 R

*Primary Examiner*—Jerry Smith

*Assistant Examiner*—Allen MacDonald

[57] ABSTRACT

There is provided a program automaton for a weaving machine that includes means for effecting deweaving when there is more than one color in the repeat. The invention includes programmable counter means and a counter-switch. On deweaving, the counter means is decremented until it reaches zero. The counter-switch is then decremented one position while the counter means is reset and rapidly decremented to the programmed limit for the preceeding color in the repeat.

6 Claims, 2 Drawing Figures

PROGRAM AUTOMATON FOR WEAVING MACHINES

BACKGROUND OF THE INVENTION

This invention relates to a device, a program automaton for weaving machines, finding application in the textile industry, especially in weaving and knitting.

A program automaton for weaving machines is known (which is described in Bulgarian Authorship Certificate No. 14496 and corresponding U.S. Pat. No. 3,674,991) with program nodes where a block for programming the weft comprises three or more series-connected electronic counters with decimal decoders, one electronic counter with decoder or two decade counters with decoders, playing the role of electronic switches, and a number of four-input AND-gates which number depends upon the number of the outputs of the decoder of the electronic switch. It is known as well that with ten-positional keys, connected with the outputs of the decoders and the inputs of the AND-gates, the program can be set. It is well known that all electronic counters applied in the program automaton are bidirectional in order to return back or reverse the program, which is necessary in view of the technological requirements of weaving, i.e. the necessity of deweaving several wefts, in the event that the stopping mechanism is not in action, to avoid faults in weaving.

Modern electronic counter circuits are bidirectional with two inputs—one for adding and another for subtracting. Therefore, they can add from 0 to 9, if decimal, and from 0 to 15, if hexadecimal. Conversely, they can subtract from 9 to 0, or from 15 to 0, repeating the cycle for addition and for subtraction. The counters operate similarly also when they are series-connected, i.e. for counting units, tens, hundreds, etc. The known program automaton for weaving machines is realized in a way that, with a minimum number of counters and minimum time for programming, it is possible for a large range of repeats to be set, e.g. to set a program of 1600 wefts with three counters for only two minutes, with 16 color tapes or bands in the repeat. Only two counters—for units and tens—are used for that purpose, along with one counter-switch, as at every one of the 16 colors after counting out one of them, the two counters are nulled and rebegin the counting. At a given decision of the program automaton, the weaving (adding) does not create problems. The deweaving (subtraction), when a deweaving is only of wefts from the color to which position the counter-switch is set, also does not create problems. However, a disadvantage of the known automaton is that when the deweaving has to continue to another color of the repeat, there are some difficulties at the returning of the counter-switch and at the series-connected counters, especially for the subtraction of digits, e.g. 100−16, 100−24, 100−36, 100−17, etc., because the counters for subtraction only count from 99 to 0, etc.

SUMMARY OF THE INVENTION

The task of the invention is to create a program automaton for weaving machines into which block for weft programming is incorporated a block for deweaving of complex programs, with a possibility for continuation of the deweaving of another color of the repeat.

This task is solved by a program automaton for weaving machines, comprising a transducer, connected to the crankshaft of the weaving machine and to a block for weft programming. The block for weft programming is connected to a block for subroutines and to control electromagnets for color selection. The block for subroutines is connected in a feedback path with the block for weft programming. The transducer is also connected to a block for weave programming, which, in turn, is connected to an electronic keys block. This electronic keys block is connected to a control block for controlling two blocks of electromagnets, the control block being further connected to the transducer. In the blocks for weft programming and for subroutines, there is included a block for deweaving at complex programs, comprising a reverse key, a first AND-gate, the output of which is connected to one of the inputs of a two-input static flip-flop, the other input being connected to the output of a bank of second AND-gates of the program automaton for weaving machines. The output of the first AND-gate is also connected to the input for subtraction of the counter-switch. A rectangular pulse generator is connected to one input of a two-input AND-gate while the second input of the AND-gate is connected with one of the outputs of the static flip-flop, and the output of the AND-gate is connected, by means of an OR-gate, to the input for subtraction of a units counter, to which is also connected the transducer for supplying pulses from the crankshaft of the weaving machine.

DESCRIPTION OF THE DRAWINGS

Figures illustrating the invention are shown in the enclosed drawings, where.

DESCRIPTION OF THE PREFERRED EMBODIMENT

Figure 1:
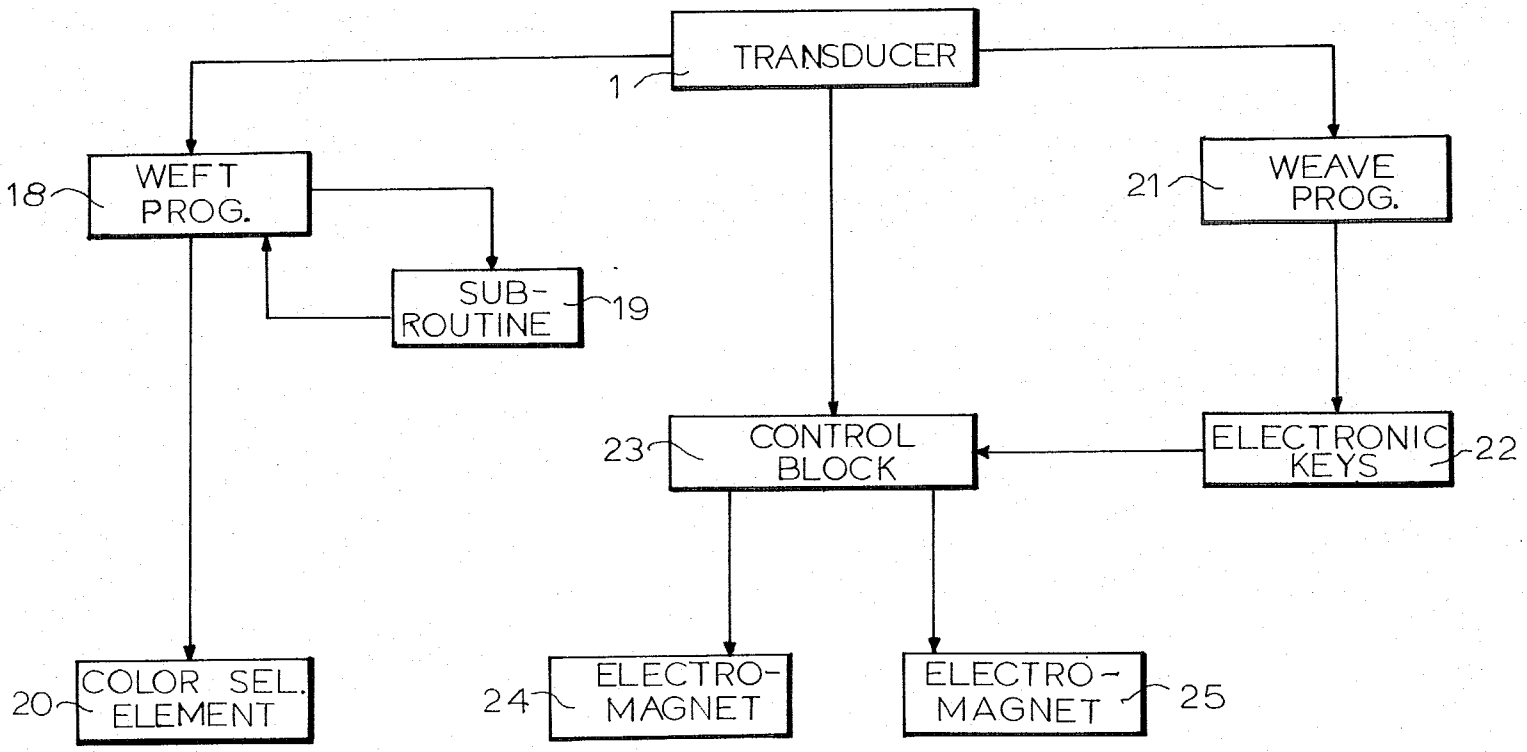
FIG. 1 illustrates a block scheme of the program automaton for weaving machines.

Referring to FIG. 1, the program automaton for weaving machines comprises a transducer 1 which is coupled to the crankshaft of a weaving machine and generates an output pulse for each revolution of the crankshaft in the forward direction, each revolution indicating the weaving of one weft. The transducer 1 is connected to a block for weft programming 18 which, in turn, is connected to a block for subroutines 19 and to electromagnets of color selection elements 20 which alternatively select the various color bands. The block for subroutines 19 is connected in a feedback loop with the block for weft programming 18. The transducer 1 is further connected to a block for weave programming 21 which, in turn, is connected to an electronic keys block 22. The keys block 22 is connected to a control block 23 which controls two blocks of electromagnets 24 and 25 which, in turn, control the formation of each weft. The transducer 1 is also connected to the control block 23.

Figure 2:
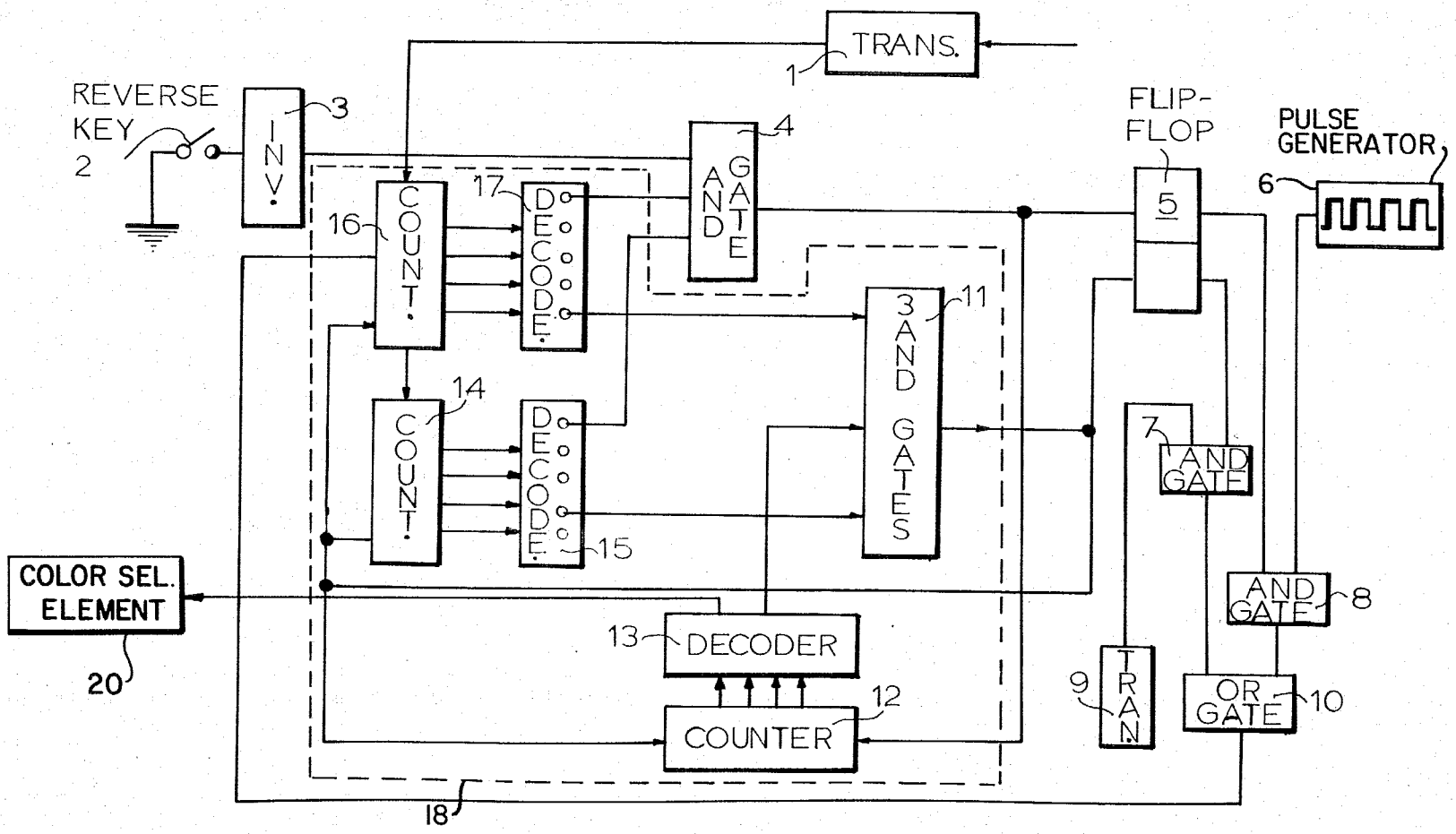
FIG. 2 illustrates the built-in block for deweaving of complex programs.

The block for deweaving of complex programs is incorporated in the blocks 18 and 19 and, referring to FIG. 2, comprises a reverse key 2 having one end connected to ground and the other end connected to an inverter 3. The output of the inverter 3 is connected to one input of a three-input AND-gate 4, the output thereof being connected to one input of a static flip-flop 5. A first output of the flip-flop 5 is connected to an AND-gate 8 while a pulse generator 6, having an output frequency of, for example, 1000 Hz, to 5000 Hz., is also connected to AND-gate 8. A second output of flip-flop 5 is connected to an AND-gate 7 to which the output of a transducer 9 is also applied. The transducer 9, like transducer 1, is connected to the crankshaft of the weaving machine and produces an output pulse for each revolution of the crankshaft in the reverse direction.

The block for deweaving further comprises three counters 12, 14 and 16 with associated decoders 13, 15 and 17, respectively. Counter-decoder 12/13 provides individual outputs corresponding to the desired number of color bands, e.g. 16, and also represents the output of 18 which controls color selection elements 20 in FIG. 1. Counter 14 is coupled to counter 16 such that the counter-decoders 14/15 and 16/17 provide individual outputs representing the number of wefts, ten and units, respectively. Transducer 1 is coupled to the counting input of counter 16 while the null outputs of decoders 15 and 17 are connected respectively to the other two inputs of AND-gate 4. Each of the outputs of counter-decoder 12/13 is connected an input each of a bank of respective three-input AND-gates 11, the other respective inputs being selectively connected to the outputs of counter-decoders 14/15 and 16/17 whereby the desired number of wefts for each color band may be programmed. The outputs of the AND-gates 11 are combined and applied to a second input of flip-flop 5, the resetting inputs of counters 14 and 16 and to the incrementing input of counter 12. For subtractions, the output of AND-gate 4 is applied to the decrementing input of counter 12, while the outputs from AND-gates 7 and 8 are applied, through an OR-gate 10, to the subtracting input of counter 16.

The operation of the block for deweaving of complex programs will now be described. At the necessity of deweaving, the reverse key 2 is switched and a logic "one" appears at the output of inverter 3. Assuming that one or both of the counter-decoders 14/15 and 16/17 are not at their respective null positions, the second output of flip-flop 5 is at logic "one" which then activates AND-gate 7 allowing pulses from transducer 9 to pass through OR-gate 10 decrementing counter 16 and, in turn, counter 14. When both counters 16 and 14 reach zero, the null outputs from decoders 17 and 15, along with the logic "one" from inverter 3, cause AND-gate 4 to produce a logic "one" output. This logic "one" output then decrements counter 12 one position while changing the state of flip-flop 5 which then turns off AND-gate 7 and applies a logic "one" to AND-gate 8 which allows the pulses from generator 6 to rapidly decrement the counters 16 and 14. At the point where the outputs of the decoders 17 and 15 correspond to the AND-gate of the bank of AND-gates 11 selected by the output of the decoder 13, the output therefrom switches to a logic "one", again changing the state of flip-flop 5 which thereupon turns off AND-gate 8 and turns on AND-gate 7 allowing the block to continue the deweaving process for the particular color band. The above procedure repeats for the rest of the sequence of color bands until deweaving is terminated.

I claim:

1. A program automaton for a weaving machine having a transducer coupled to a crankshaft therein, a block for weft programming coupled to said transducer, a block for subroutines coupled in a feedback loop with said block for weft programming, a block of selective electromagnets coupled to said block for weft programming for alternatively selecting a color band, a block for weave programming also coupled to said transducer, an electronic keys block coupled to said block for weave programming, a control block coupled to both said transducer and said electronic keys block for controlling weaving electromagnets, and a block for deweaving of complex programs incorporated in said blocks for weft programming and subroutines, characterized in that said block for deweaving at complex programs comprises:

means for indicating the reversal of said weaving machine;

a first AND-gate coupled to said indicating means;

a counter-switch having an addition and subtraction input, the output of said first AND-gate being coupled to said subtraction input;

a high-frequency pulse generator;

a second AND-gate coupled to the output of said high-frequency pulse generator and also to said first AND-gate; and counter means also having an addition and a subtraction input, said second AND-gate being coupled through an OR-gate to said subtraction input, said transducer also being coupled to said OR-gate, said counter means having outputs coupled to said first AND-gate.

2. A program automaton as set forth in claim 1, characterized in that said counter means comprises counters for units and tens, followed by respective decimal decoders.

3. A program automaton as set forth in claim 1 or 2, which further comprises a flip-flop coupling the output of said first AND-gate to the input of said second AND-gate.

4. A program automaton as claimed in claim 3, which further comprises AND-gate means, having inputs coupled to the outputs of said counter means and said counter-switch, for supplying a reset pulse to said counter means.

5. A program automaton as claimed in claim 4, characterized in that said flip-flop further comprises a second input to which the output of said AND-gate means is applied.

6. A program automaton as claimed in claim 5, characterized in that said transducer is coupled to said OR-gate through a third AND-gate controlled by said flip-flop to be open and closed when said first AND-gate is closed or open, respectively.

* * * * *